United States Patent [19]

Billman et al.

[11] Patent Number: 4,978,307

[45] Date of Patent: Dec. 18, 1990

[54] ELECTRICAL SOCKET FOR SUBSTRATES

[75] Inventors: Timothy B. Billman, King, N.C.; Attalee S. Taylor, Palmyra, Pa.

[73] Assignee: AMP Incorporated, Harrisburg, Pa.

[21] Appl. No.: 390,590

[22] Filed: Aug. 7, 1989

[51] Int. Cl.[5] ..... H01R 9/09

[52] U.S. Cl. ..... 439/83; 439/84; 439/858; 439/885

[58] Field of Search ..... 361/400, 403, 404, 405; 439/55, 59, 78, 81, 82, 83, 84, 590, 629, 630, 636, 885, 683, 856, 857, 858, 861

[56] References Cited

U.S. PATENT DOCUMENTS

| | | | |
|---|---|---|---|
| 2,782,389 | 2/1957 | Sunko et al. | 439/683 |
| 2,882,512 | 4/1959 | Morone, Jr. | 439/683 |
| 3,340,440 | 9/1967 | Minter | 439/82 |
| 3,781,770 | 12/1973 | Mancini . | |
| 3,803,537 | 4/1974 | Cobaugh et al. . | |
| 4,245,876 | 1/1981 | Ritchie et al. | 439/590 |
| 4,270,829 | 6/1981 | Wilson | 439/83 |
| 4,436,358 | 3/1984 | Coldren et al. | 439/83 |
| 4,498,725 | 2/1985 | Bright et al. . | |
| 4,592,617 | 6/1986 | Seidler | 439/83 X |
| 4,695,106 | 9/1987 | Feldman et al. | 439/83 |
| 4,726,793 | 2/1988 | Bright | 439/751 |

FOREIGN PATENT DOCUMENTS

| | | | |
|---|---|---|---|
| 0040942 | 12/1981 | European Pat. Off. | 439/78 |

*Primary Examiner*—Neil Abrams
*Assistant Examiner*—Khiem Nguyen
*Attorney, Agent, or Firm*—Allan B. Osborne

[57] ABSTRACT

An electrical socket for substrates and particularly ceramic substrates. More particularly, the socket includes a U-shaped receptacle and a mounting section for attaching the receptacle to the substrate. The mounting section is attached to one leg of the receptacle and includes a solder foot for being soldered to a circuit pad on the substrate.

4 Claims, 2 Drawing Sheets

ELECTRICAL SOCKET FOR SUBSTRATES

FIELD OF THE INVENTION

The disclosed invention relates to sockets mounted on a substrate and for receiving leads or posts on electronic packages.

BACKGROUND OF THE INVENTION

The prior art is replete with disclosures relating to sockets mounted on printed circuit boards for receiving leads or posts extending outwardly from electronic packages such as integrated circuit packages. For example, U.S. Pat. No. 3,803,537 to Cobaugh et al. exemplifies the many patents disclosing the well known mini-spring sockets which are mounted in holes in the circuit board. U.S. Pat. No. 3,781,770 to Mancini relates to another type socket which includes a collar 30 soldered in the hole and socket body 16 extending substantially above the upper surface of the board for receiving a flat lead. Other types of sockets include those having a U-shaped or twin beam receptacle and are generally adapted for receiving a round lead, often times referred to as a post or pin. In these type sockets, the receptacle extends above the upper surface and is electrically attached to the board's circuits by a portion extending into a hole or by a solder foot soldered to a circuit pad on the board's surface. U.S. Pat. No. 4,498,725 illustrates sockets of the above type having a lead for being soldered into a hole while U.S. Pat. No. 4,726,793 discloses sockets having a solder foot for being soldered onto a circuit pad on the upper surface. In these two examples, housings for retaining the sockets are provided.

However, in all of the known prior art, no electrical sockets have been developed for use on substrates which undergo repeated reflow soldering, a method frequently used to add sequentially, electronic packages or components at very high temperatures; e.g., 689° F (365° C.) and for extended lengths of time; e.g., two minutes. Accordingly, it is now proposed to provide electrical sockets which are capable of withstanding repeated reflow operations at such temperatures and over such extended times and further which do not require housings.

SUMMARY OF THE INVENTION

According to the invention, an electrical socket for use on substrates and the like is provided. The socket includes a U-shaped receptacle defined by a pair of legs joined by a bight extending therebetween and a mounting section extending from an end of one leg and having a terminating portion for electrically connecting and mechanically attaching the receptacle to a substrate.

DESCRIPTION OF THE INVENTION

Figure 1:
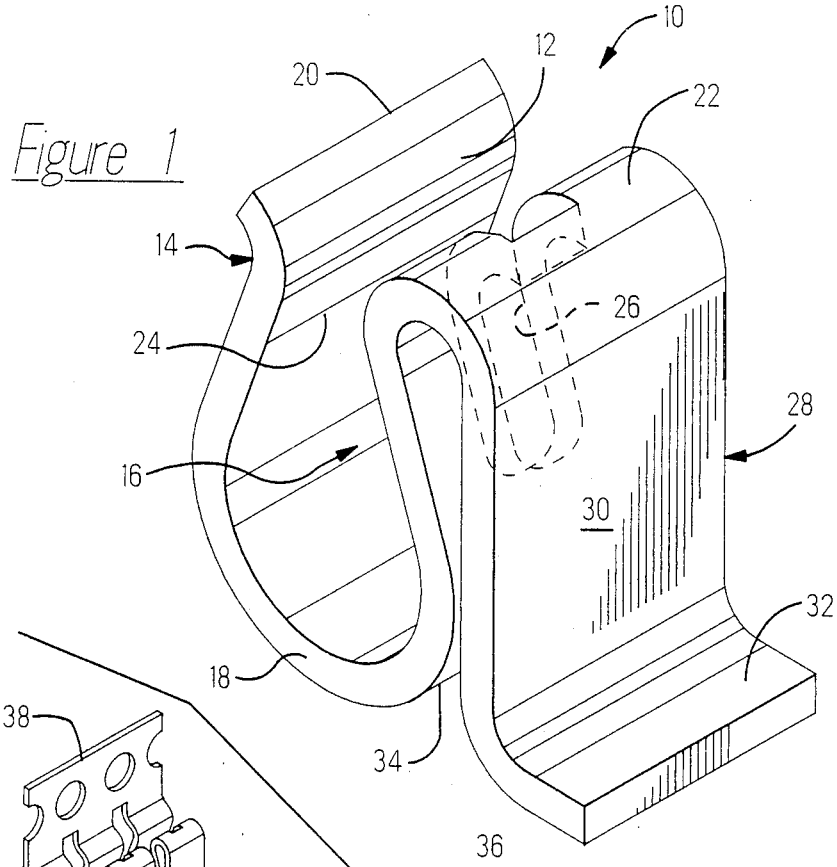
FIG. 1 is a perspective view of a first embodiment of the socket according to the present invention.

Socket 10 shown in FIGS. 1 through 4 include U-shaped receptacle 12 which is defined by legs 14,16 and bight 18. Legs 14,16 approach each other from their attachment to bight 18 towards distal ends 20,22 respectively and thereafter diverge to define a narrow opening 24. Leg 16 is provided with longitudinal slot 26 which extends from near bight 18 and around distal end 22. Both distal ends 20, 22 curves outwardly to define a funnel leading to opening 24.

Whereas leg 14 terminates with distal end 20, leg 16 is connected at its distal end 22 to mounting section 28 which is L-shaped and includes strap 30 and solder foot 32. Strap 30 generally parallels leg 16 and solder foot 32 projects outwardly away from receptacle 12. As shown clearly in FIG. 3 the under surfaces 34 of bight 18 and 36 of solder foot 32 are on the same plane. Slot 26 may continue down strap 30 as shown.

Socket 10 is preferrably made from beryllium nickel with the amount of nickel being about 99 percent.

The preferred method of making socket 10 is by stamping and forming with socket 10 being carried on carrier strip 38 during manufacturing, storage, shipping and handling. As shown, strip 38 is attached to distal end 20 of leg 14.

Figure 2:
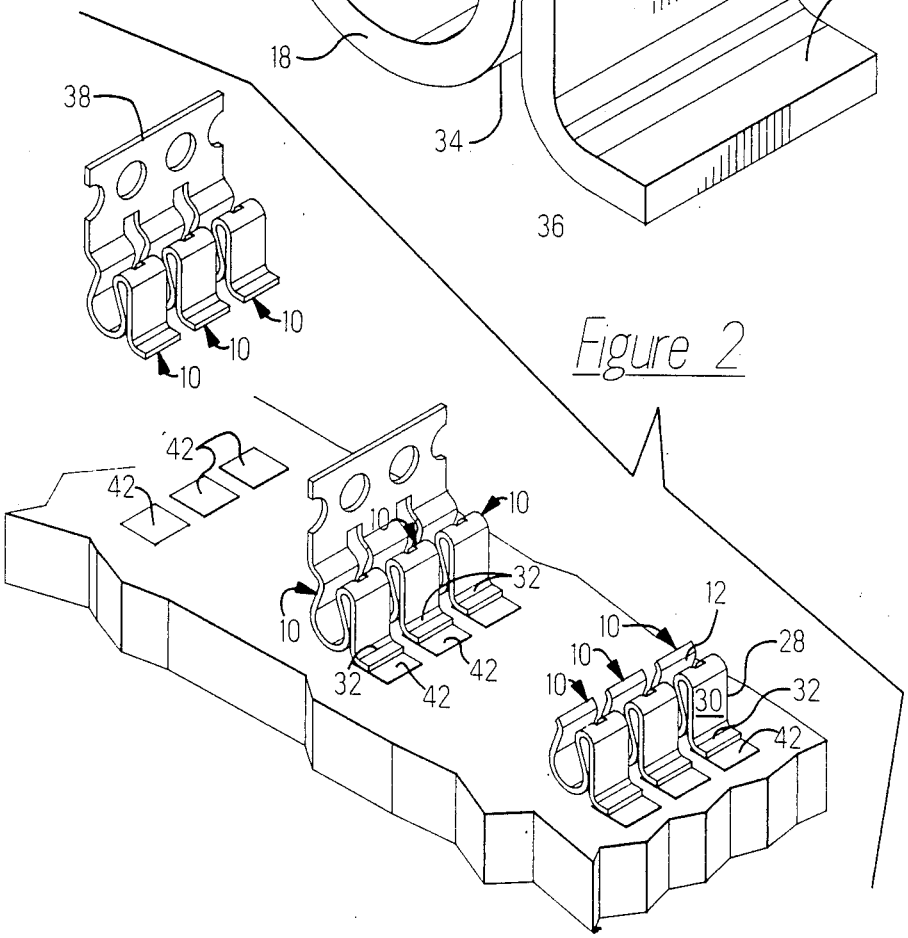
FIG. 2 shows the steps of attaching the socket to a substrate.

FIG. 2 shows the steps of attaching three sockets 10 to a substrate 40. In the process, the three sockets 10 remain attached to strip 38 until after the reflow operations. Solder feet 32 on the three sockets 10 are placed on adjacent circuit pads 42 as shown to the left and in the center of the drawing. A solder paste (not shown) previously placed on pads 42 is reflowed to secure sockets 10 to substrate 40. After the final reflow, carrier strip 38 is broken away to electrically isolate sockets 10 from each other as shown to the right in FIG. 2.

Figure 3:
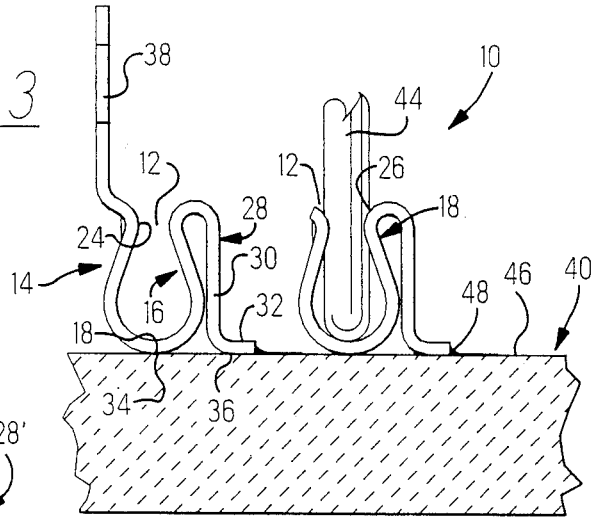
FIG. 3 is a side view of sockets on the substrate.

FIG. 3 is a side view showing two sockets 10 mounted on substrate 40. The carrier strip 38 is still on the socket 10 to the left and a post 44, attached to an electronic package (ns) is shown inserted in receptacle 12 in socket 10 to the right. As post 44 enters narrow opening 24, it is confined laterally and directed downwardly by slot 26 in leg 16. This feature will even straighten slightly bent posts (ns).

FIG. 3 also shows that under surface 34 rests on upper surface 46 of substrate 40. This provides substantial support for socket 10 and takes stress from solder joint 48.

Figure 4:
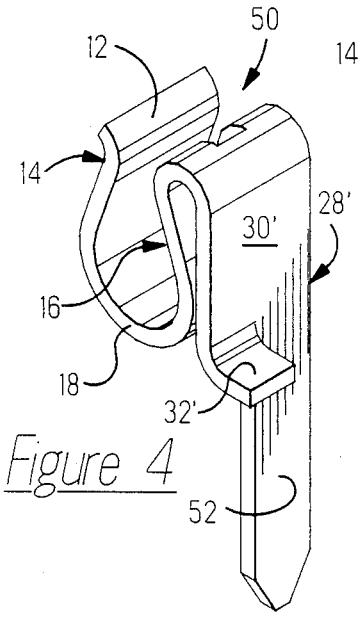
FIG. 4 is a perspective view of a second embodiment of the socket according to the present invention.
Figure 5:
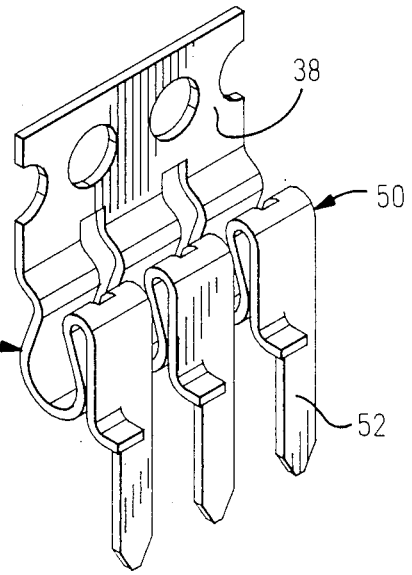
FIG. 5 shows three sockets of FIG. 4 on a carrier strip.
Figure 6:
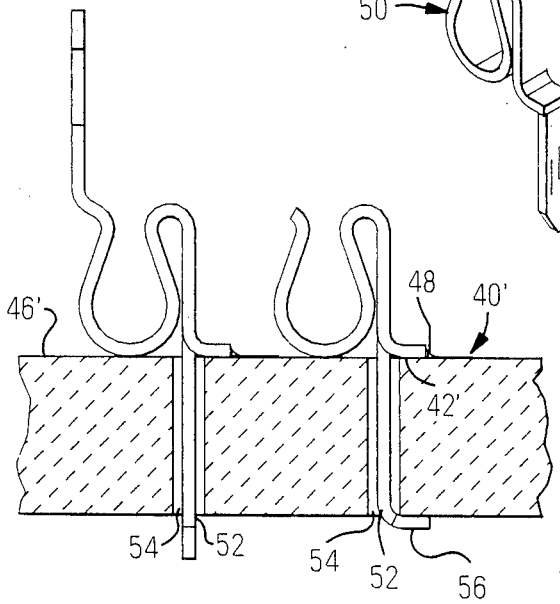
FIG. 6 is a side view of sockets of FIG. 4.

FIGS. 4, 5 and 6 show socket 50 which is a second embodiment of the present invention. Socket 50 includes all of the components of socket 10; e.g., receptacle 12, legs 14, 16, bight 18, etc. Only section 28 has been modified. Mounting section 28' on socket 50 includes strap 30', solder foot 32' and tab 52. Solder foot 32' is only about half as wide as solder foot 32. Tab 52 as shown extends beyond under surfaces 34 of bight 18 and 36' of solder foot 32 by a distance slightly greater than the thickness of substrate 40' shown in FIG. 6. Note that slot 20 terminates at distal end 22.

FIG. 5 shows three sockets 50 attached to carrier strip 38 above a portion of substrate 40'.

FIG. 6 shows substrate 40' with holes 54 therethrough adjacent circuit pads 42'. Socket 50 on the left has been placed on surface 46' with tab 52 extending through hole 54. Tip 56 of tab 52 is then bent around as shown on the right prior to the reflow operations. Socket 50 is thusly secured to substrate 40' and does not require Another embodiment of socket 50 would include a terminating portion such as a compliant section, as shown in U.S. Pat. No. 4,857,018, in lieu of tab 52 and which would be frictionally received in hole 54. If hole 54 were a plated-through hole, the terminating portion would provide both the electrically connection as well as furnishing the mechanical attachment. Solder foot 32' could be omitted or if left on, would provide stabilization for the compliant section as well as for receptacle 12 in conjunction with under surface 34 of bight 18.

As can now be discerned, an electrical socket has been disclosed for use on substrates and particularly on ceramic substrates. The socket includes a U-shaped receptacle and a mounting section attached thereto for electrically connecting and mechanically mounting the socket to a substrate by reflow soldering. In one embodiment, a clinching tab is included on the mounting tab to secure the socket to the substrate during reflow soldering.

We claim:

1. An electrical socket for mounting on a substrate and for receiving a post extending from an electronic package, comprising:

a receptacle having a bight and a pair of legs extending outwardly from each side of said bight to define a U-shaped receptacle, one leg thereof being provided with a longitudinal slot extending from adjacent one end to adjacent said bight, said slot being adapted to guide a post being inserted into said receptacle; and a mounting section attached to and extending from one of said legs and having a strap which extends generally parallel to said legs and a solder foot attached to a free end of said strap and extending outwardly away from said receptacle, said solder foot adapted for being soldered to a circuit pad on a substrate.

2. The electrical socket of claim 2 wherein said legs converge towards free ends thereof.

3. An electrical socket for use on a substrate and for receiving a cylindrical post, said socket comprising:

a stamped and formed U-shaped receptacle having a pair of spaced apart converging legs for frictionally receiving therebetween a cylindrical post, one of said legs having a longitudinal slot extending from adjacent one end to adjacent a bight attached to and extending between said legs, said slot adapted for receiving and guiding the post; and a mounting section including a tab for being inserted thru a hole in a substrate and having a free end for being bent to bear against a surface of the substrate and further including a strap for attaching said tab to one of said legs of said receptacle.

4. An electrical socket for mounting on a substrate and for receiving a post extending from an electronic package, comprising:

a receptacle having a bight and a pair of legs extending outwardly from each side of said bight to define a U-shaped receptacle, one leg thereof being provided with a longitudinal slot extending from adjacent one end to adjacent said bight, said slot being adapted to guide a post being inserted into said receptacle; and a mounting section attached to and extending from one of said legs and having a strap which extends generally parallel to said legs and a terminal having a compliant section thereon for being frictionally received in a hole in the substrate.

* * * * *

UNITED STATES PATENT OFFICE

CERTIFICATE OF CORRECTION

Patent No. 4,978,307 Dated December 18, 1990

Inventor(s) Timothy Billman and Attalee Taylor

It is certified that error appears in the above-identified patent and that said Letters Patent is hereby corrected as shown below:

In the Claims:

Claim 2, Column 4, Line 3 - Change "claim 2" to read --claim 1--.

Signed and Sealed this

Eighth Day of September, 1992

*Attest:*

DOUGLAS B. COMER

*Attesting Officer*

*Acting Commissioner of Patents and Trademarks*